United States Patent [19]

Earl

[11] 4,067,593

[45] Jan. 10, 1978

[54] ADJUSTABLE PLATFORM SKI BINDING MOUNT

[76] Inventor: Arthur W. Earl, 451 Essex Ave., Bloomfield, N.J. 07003

[21] Appl. No.: 680,861

[22] Filed: Apr. 27, 1976

[51] Int. Cl.[2] ..... A63C 9/00

[52] U.S. Cl. ..... 280/617; 280/607; 280/633; 280/636

[58] Field of Search ..... 280/617, 618, 607, 616, 280/611, 614, 636, 633; 9/310 AA

[56] References Cited

U.S. PATENT DOCUMENTS

| | | | |
|---|---|---|---|
| 3,079,165 | 2/1963 | Von Bosio | 280/636 |
| 3,314,687 | 4/1967 | Tiesler | 280/617 |
| 3,675,938 | 7/1972 | Sigl | 280/607 |
| 3,797,839 | 3/1974 | Smolka et al. | 280/617 |
| 3,806,144 | 4/1974 | Yans et al. | 280/636 |
| 3,845,965 | 11/1974 | Lipe | 280/636 |
| 3,927,895 | 12/1975 | Spier et al. | 280/636 |
| 3,937,481 | 2/1976 | Koleda | 280/617 |

*Primary Examiner*—Joseph F. Peters, Jr.
*Assistant Examiner*—Milton L. Smith
*Attorney, Agent, or Firm*—Jay M. Cantor

[57] ABSTRACT

A platform base mounted on a ski is provided with a pair of separated heel and toe platforms which are relatively movable thereon, each of which carries a fixed or adjustable ski binding thereon. The heel and toe platforms are adjustably connected together for movement relative to each other and as a unit along the platform base. The platform base has only an intermediate length thereof in contact with and secured to the upper surface of the ski, which length is shorter than the combined length of the heel and toe platforms.

23 Claims, 9 Drawing Figures

ADJUSTABLE PLATFORM SKI BINDING MOUNT

BACKGROUND OF THE INVENTION

Conventional ski bindings are mounted directly on the ski. The conventional toe binding is mounted in front of the ski boot toward the tip of the ski. The ski boot rests in the center of the ski on the thick foot pad area. Then, the conventional heel binding is mounted behind the ski boot toward the tail of the ski.

Conventional ski bindings, when mounted directly on the ski, in front and back of the ski boot, restrict the flexibility of the ski. This tends to limit the ski's ability to flex with the contours of the snow. Also, the ski boot, because it rests directly on the ski, drags in the snow. This, at times, is a safety hazard because it prevents good edge bite of the ski. The most serious disadvantage when conventional ski bindings are mounted directly on the ski is the inaccuracy of the conventional toe and heel binding's safety releases. This occurs with every flexing of the toe and/or tail of the ski, because each flexing movement applies a different toe and heel binding pressure on the ski boot. Therefore, the erratic pressures causes the safety releases to operate inconsistently. This greatly increases the potential accident hazard in skiing.

BRIEF SUMMARY OF THE INVENTION

The invention relates generally to skis and is particularly related to ski binding improvements which permit an integrated toe and heel ski binding system or any conventional toe and heel ski binding to be mounted on any size ski. Also, it accepts any size ski boot and readily adjusts the ball of the foot over the midpoint of the running surface of the ski.

Ski manufacturers recommend that the ideal location of a ski binding is when the ball of the foot is located directly over the midpoint of the running surface of the ski. However, most ski shop technicians, to speed up the mounting process, simply locate the toe of the ski boot at the mid-chord-point of the ski. The assumption is that the ball of the foot will fall approximately over the midpoint of the running surface of the ski. Therefore, this mounting problem can readily be corrected by the adjustable platform ski binding mount.

An important object of correct ski binding mounting should be neutral steer sensitivity. Otherwise, oversteer or understeer are created. There two factors can be corrected only by relocating the position of the ski binding on the ski. Therefore, neutral steer sensitivity can be readily accomplished with the adjustable platform ski binding mount.

The platform base of the adjustable ski binding mount is fastened rigidly at the center of the thick ski foot pad area. A maximum of four screws holds the platform base securely to the ski. Therefore, the entire weight load is transmitted directly to the middle of the running surface of the ski. This tends to distribute the weight load evenly to the tip and tail of the ski.

The adjustable heel binding platform permits the platform ski binding mount to be adjusted to any size ski boot. Also, the adjustable toe/heel binding platform permits the ball of the foot, while in the ski boot, to be located by adjustment directly over the midpoint of the running surface of the ski.

The toe binding mount area is used for mounting an integrated toe binding system or conventional toe binding of the skiers choice. Also, the heel binding mount area is used for mounting an integrated heel binding system or conventional heel binding of the skier's choice. When the skier navigates a turn, the torque pressure created by the twisting motion of the body is transmitted through the ski boots to the conventional toe and heel bindings. Because the integrated system or the conventional toe and heel bindings are mounted at the ends of the adjustable platform ski binding mount, the body turning torque pressure is transmitted through the mount area of the platform to the midpoint of the running surface of the ski. This radial turning torque pressure assures equal turning motion to the tip and tail of the ski. Thus, more effortless neutral steer turns are assured.

The surface treatment, where the ski boot rests, can be varied to assure effortless lateral and/or revolving ski boot movement according to the motion requirements of an integrated ski binding system or conventional ski binding(s). Or, the surface can be left plain for conventional ski bindings that contain ski boot sole friction reduction devices. Or, the surface can be treated with any other externally applied commercial type friction reduction device. Also, the surface can be treated, with any shock absorbing device which absorbs lateral shock loads.

The surface treatment could employ the use of flexible endless belts, thrust bearings, roller bearings and/or shock absorbing devices such as a polytetrafluoroethylene pad. Any one of these or a combination of them, could be mounted directly in front of the toe and heel bindings. These devices would always remain directly under the toe, center, or heel of the ski boot, even though the adjustable platform can be set to accommodate any size ski boot.

OBJECTS OF THE INVENTION

It is therefore an object of this invention to provide an adjustable ski binding mount using a relatively small ski fastening area.

It is a further object of this invention to provide a ski binding mount that permits complete flexibility of the ski.

It is a further object of this invention to provide the ski with complete ski edge bite along the entire length of the ski edge.

It is still a further object of this invention to provide an adjustable platform ski binding mount which fits any ski.

It is still a further object of this invention to provide an adjustable platform ski binding mount wherein the ski boot is raised above the snow to prevent it from dragging in the snow.

It is still a further object of this invention to provide an adjustable platform ski binding mount capable of being aligned over the midpoint of the running surface of the ski.

It is still a further object of this invention to provide an adjustable platform ski binding mount that will permit the use of an integrated ski binding system or conventional ski bindings of the skier's choice.

It is still a further object of this invention to provide an adjustable platform ski binding mount that will accept any size ski boot.

It is still a further object of this invention to provide an adjustable platform ski binding mount with an internally or externally mounted surface treatment that will permit the ski boot to effortlessly move in a lateral and/or revolving motion.

It is still a further object of this invention to provide an adjustable platform ski binding mount with an internally or externally mounted surface treatment that will absorb shock loads.

The above objects and still further objects of this invention will become apparent to those skilled in the art after consideration of the following preferred embodiment thereof, which is provided by way of example and not by way of limitation wherein:

DESCRIPTION OF DRAWINGS

FIG. 9 is a pictorial view of the adjustable platform ski binding mount in a partially open position.

DETAILED DESCRIPTION OF PREFERRED EMBODIMENT

Figure 1:
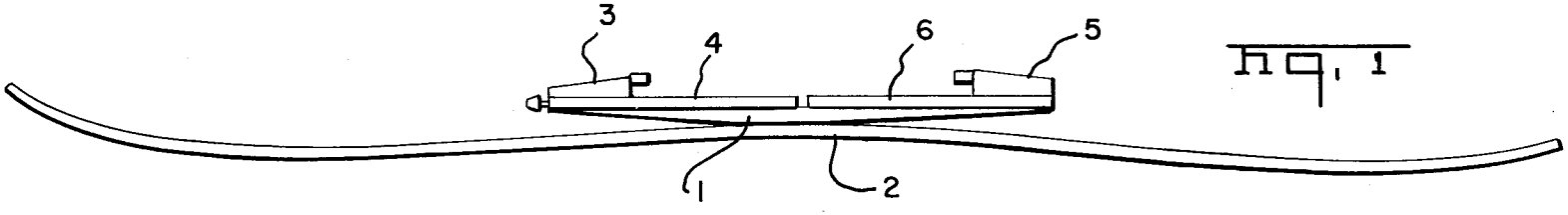
FIG. 1 is a side view of a ski with the adjustable platform ski binding mount and integrated system or conventional ski bindings in accordance with the present invention.

Referring now to FIG. 1, there is shown the adjustable platform ski binding base 1 with only a small section required to fasten it to the thick center of the ski foot pad area 2. An integrated toe binding system or a conventional toe binding 3 of the skier's choice is mounted on the adjustable toe binding platform 4. Also, an integrated heel binding system or a conventional heel binding 5 of the skier's choice is mounted on the adjustable heel binding platform 6.

Figure 2:
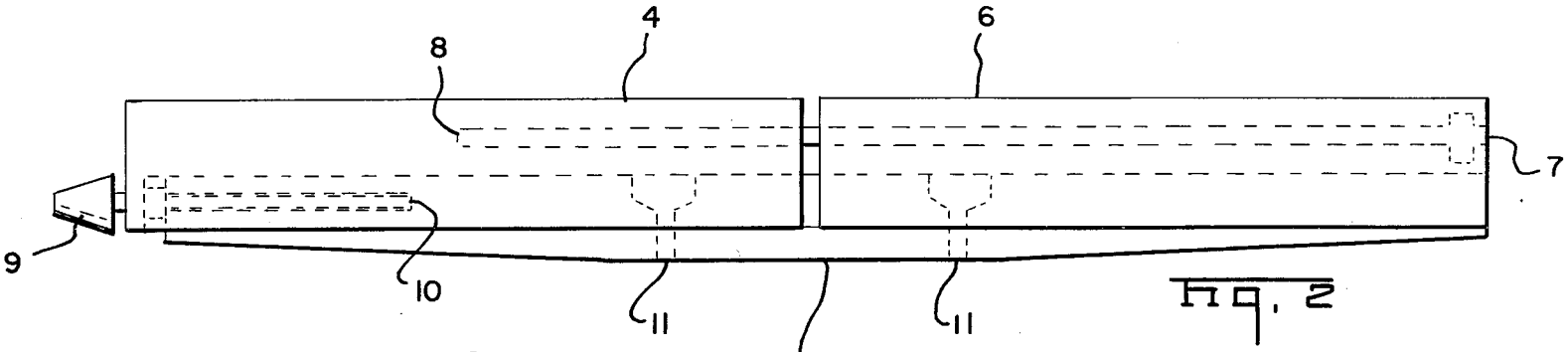
FIG. 2 is a side view of the adjustable platform ski binding mount, with basic details, in the closed position.

Referring now to FIG. 2, there is shown platform base 1 on which the adjustable toe binding platform 4 and the adjustable heel binding platform 6 are mounted.

The adjustable heel binding platform 6, which is controlled by the inset adjusting knob 7, is interconnected by the threaded shaft 8 to the adjustable toe binding platform 4. Thus, the adjustable toe binding platform 4 and the adjustable heel binding platform 6 can be adjusted to fit any size ski boot.

The inset adjusting knob 7 requires a special tool that enables only the ski shop technician to make this critical adjustment because, the setting can affect the tightness or looseness of the ski boot in the binding.

The interconnected adjustable toe/heel platform 4/6 is adjustable by the ski boot location knob 9, which is connected by threaded shaft 10 to the platform base 1. The ski boot location knob 9 permits the ski shop technician or the skier to adjust the position of the ball of the foot while in the ski boot, over the midpoint or the running surface of the ski, or, any other position of the skier's choice.

The mounting screw holes 11 provide the opportunity to securely fasten the platform base 1 to the thick foot pad area in the center of the ski 2. As shown in FIG. 1, the portion of the platform base in contact with the foot pad area of the ski is shorter than the combined lengths of the toe and heel platforms. Therefore, the entire length of the ski remains flexible.

Figure 3:
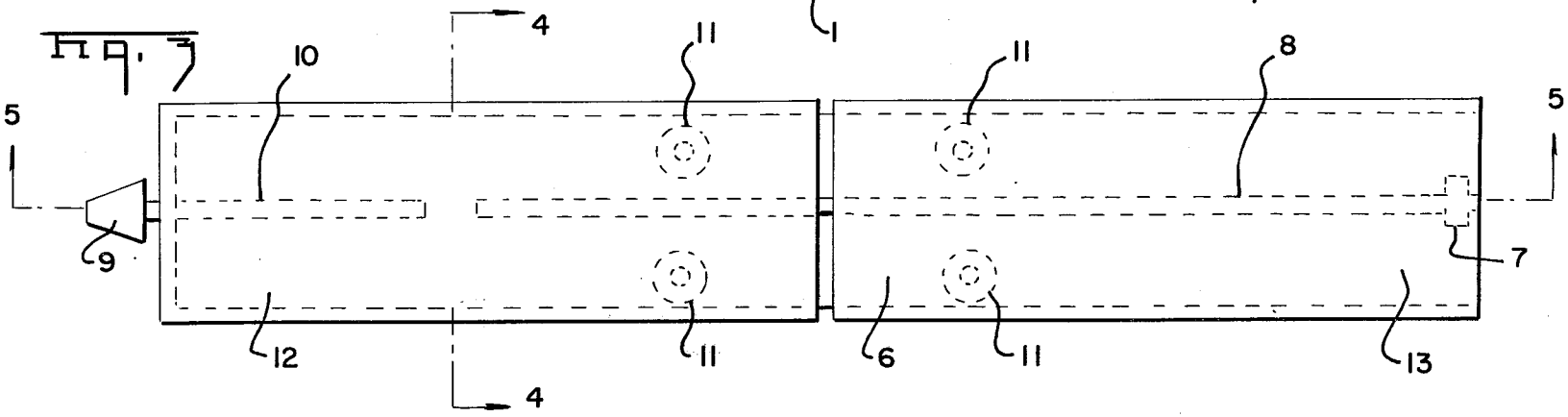
FIG. 3 is a top view of the adjustable platform ski binding mount, with basic details in the closed position.

Referring now to FIG. 3 which is a top view of the adjustable platform ski binding mount, there is a toe binding mount area 12 and a heel binding mount area 13 which permits the mounting of an integrated toe and heel ski binding system or conventional ski binding(s) of the skier's choice.

Figure 4:
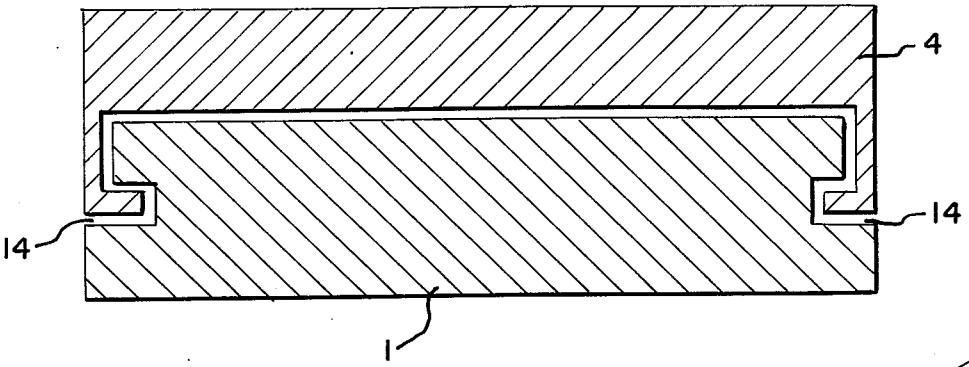
FIG. 4 is a section view of the adjustable platform ski binding mount, taken along line 4—4 of FIG. 3, emphasizing the shape of the interlocking longitudinal ways.

Referring now to FIG. 4, there are shown interlocking longitudinal ways 14. The interlocking longitudinal ways 14 guide and hold the adjustable toe binding platform 4 and the interconnected adjustable heel binding platform 6 in the selected position on the platform base 1.

Figure 5:
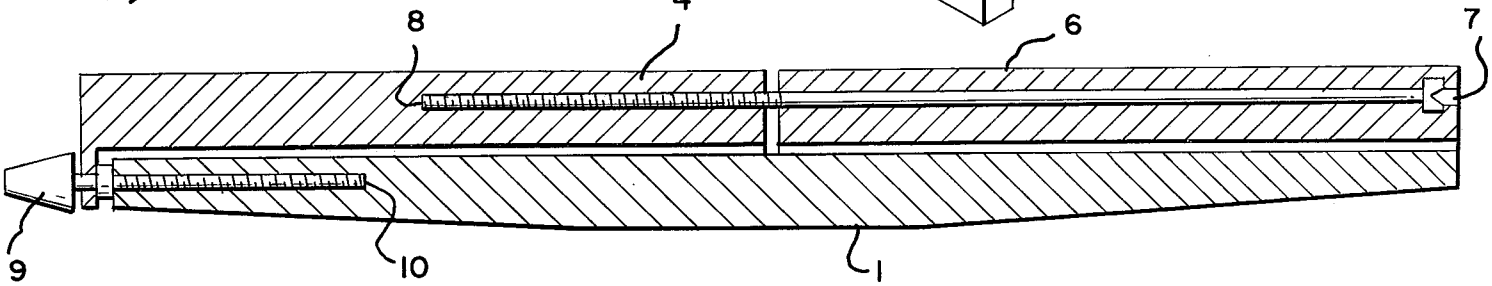
FIG. 5 is a section view of the adjustable platform ski binding mount, taken along line 5—5 of FIG. 3, emphasizing the internal details.

Referring now to FIG. 5, the threaded ski boot size adjustment shaft 8 is threaded into the adjustable toe binding platform 4. Therefore, turning the inset ski boot size adjustment knob 7 counter clockwise with a special tool opens the adjustable ski binding mount. Also, turning the inset ski boot size adjustment knob 7 clockwise with a special tool closes the adjustable ski binding mount. Thus, the ski binding mount will adjust to any size ski boot.

The threaded ski boot location shaft 10 is threaded into the platform base 1. Therefore, turning the ski boot location knob 9 counter clockwise moves the adjustable platform ski binding mount toward the toe of the ski. Also, turning the ski boot location knob 9 clockwise moves the adjustable platform and binding mount toward the tail of the ski. Thus, the ball of the foot can be readily located over the midpoint of the running surface of the ski or, any other preferable neutral steer position.

Figure 6:
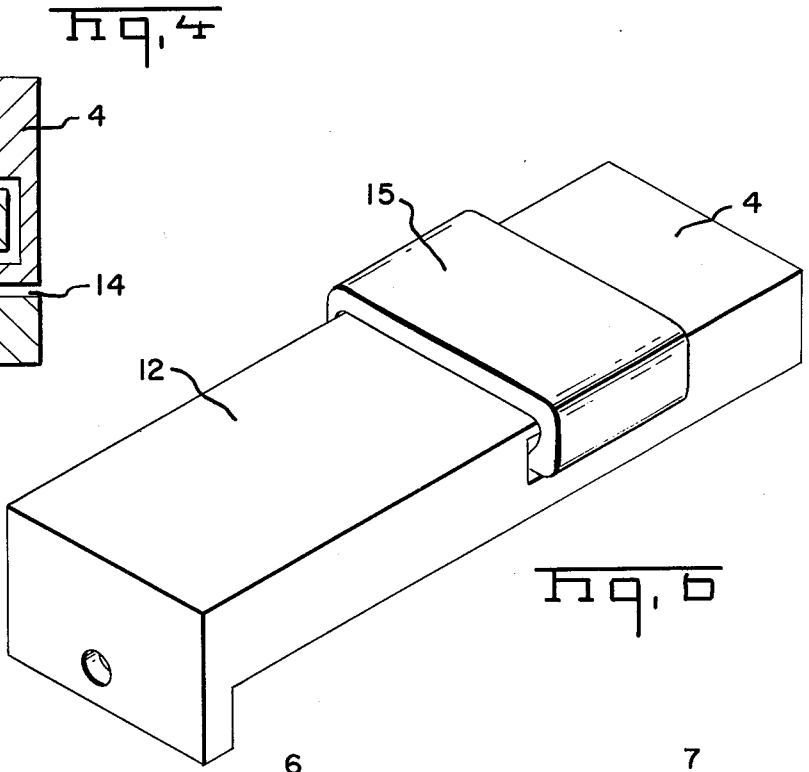
FIG. 6 is a pictorial view of the adjustable toe binding platform showing the flexible endless belt as an integral structure of the platform.

Referring now to FIG. 6, the flexible endless belt 15 is shown as an integral part of the adjustable toe binding platform 4. It is located anywhere in rear of the toe binding mount area 12 on which the integrated toe binding system or conventional toe binding 3 of the skier's choice is mounted.

Figures 7, 8:
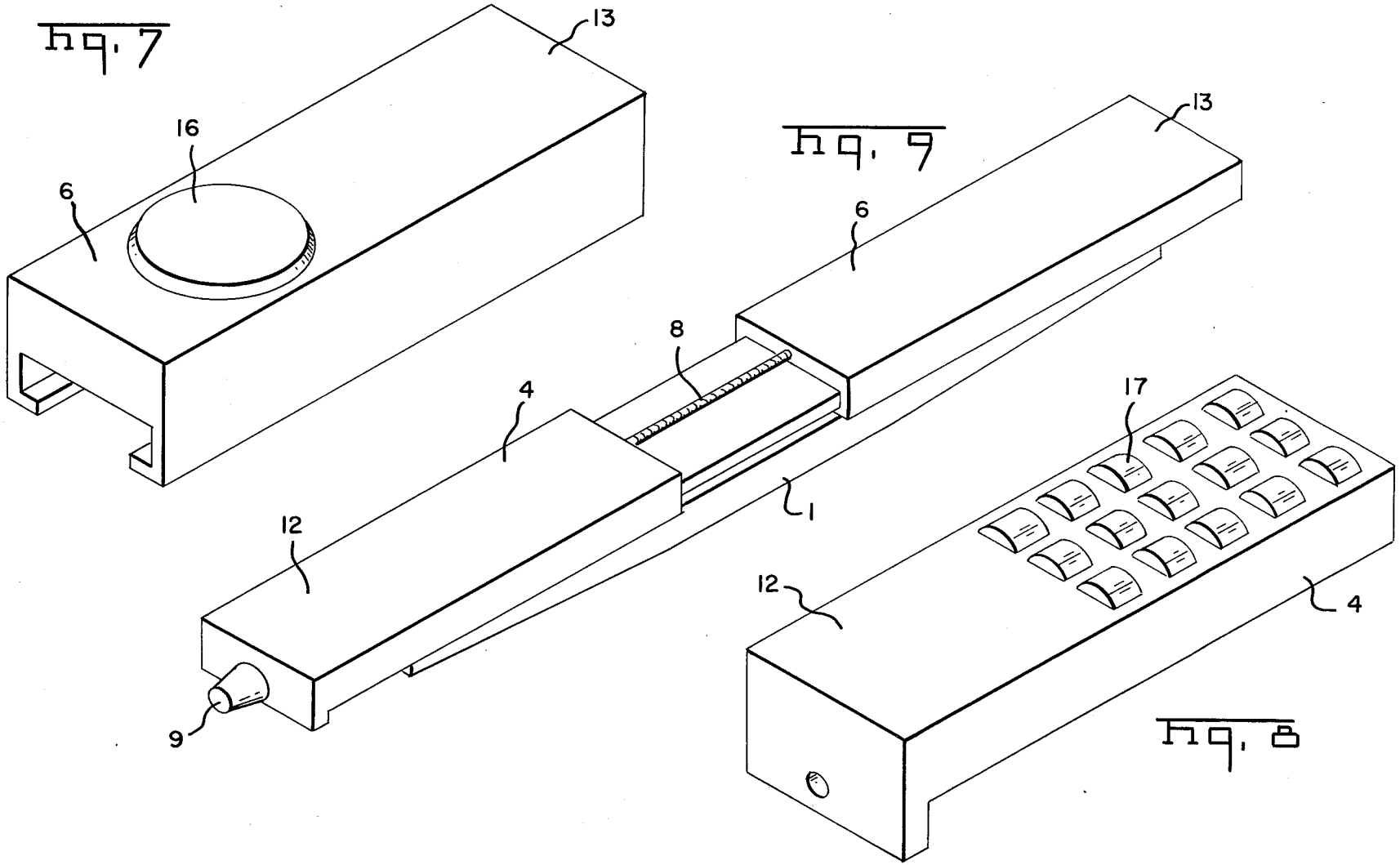
FIG. 7 is a pictorial view of the adjustable heel binding platform showing the thrust bearing as an integral structure of the platform.
FIG. 8 is a pictorial view of the adjustable toe binding platform showing the roller bearing as an integral structure of the platform.

Referring now to FIG. 7, the thrust bearing 16 is shown as an integral part of the adjustable heel binding platform 6. It is located anywhere in front of the heel binding mount area 13 on which the integrated heel binding system or conventional heel binding 5 or the skier's choice is mounted. Also, the thrust bearing surface can be treated with a smooth, rough or spiked finish.

Referring now to FIG. 8, the roller bearings 17 are shown as an integral part of the adjustable toe binding platform 4. They are located anywhere in rear of the toe binding mount area 12 on which the integrated toe binding system or conventional toe binding 3 of the skier's choice are mounted.

Referring now to FIG. 9, there is shown the adjustable platform ski binding mount in a partial open position. When a large ski boot is held in position on the adjustable toe binding platform 4 and the adjustable heel binding platform 6, the ball of the foot can still be located over the midpoint of the running surface of the ski by adjustment of the ski boot location knob 9. Thus, the body turning torque and weight load of the skier can always be transmitted to the midpoint of the running surface of the ski.

Though the invention has been described with respect to a specific preferred embodiment thereof, many variations and modifications will immediately become apparent to those skilled in the art. Therefore, it is intended that the appended claims be interpreted as broadly as possible in view of the prior art to include all such variations and modifications.

What is claimed is:

1. An adjustable platform ski binding mount for use with a ski, which comprises:
   a. a platform base secured to said ski;
   b. separate heel and toe platforms mounted on said platform base and movable on said platform base toward and away from each other;
   c. means secured in said platform base for moving said toe and heel platforms together along a surface of said platform base and
   d. means positioned in one of said toe and heel platforms for moving the other of said toe and heel platforms relative to said one of said toe and heel platforms, said platform base including a thread receiving recess extending to one outer edge thereof, said means secured including threaded means threaded into said thread receiving recess and having means engaging one of said toe and heel platforms for moving same relative to said platform base by rotation of said threaded means.

2. An adjustable platform ski binding mount as set forth in claim 1 wherein one of said heel and toe platforms has a thread receiving recess and the other defines an aperture extending completely therethrough and coaxial with said thread receiving recess and threaded means extending through said aperture secured in said platform defining said aperture and threaded to said thread receiving recess to move said heel and toe platforms relative to each other.

3. An adjustable platform ski binding mount for use with a ski, which comprises:
   a. a platform base secured to said ski;
   b. separate heel and toe platforms mounted on said platform base and movable on said platform base toward and away from each other;
   c. means secured in said platform base for moving said toe and heel platforms together along a surface of said platform base and
   d. means positioned in one of said toe and heel platforms for moving the other of said toe and heel platforms relative to said one of said toe and heel platforms wherein said heel and toe platforms are movable relative to each other along a predetermined axis and said means in (c) moves said heel and toe platforms together along with said axis, said platform base including a thread receiving recess extending to one outer edge thereof, said means secured including threaded means threaded into said thread receiving recess and having means engaging one of said toe and heel platforms for moving same relative to said platform base by rotation of said threaded means.

4. An adjustable platform ski binding mount as set forth in claim 3 wherein one of said heel and toe platforms has a thread receiving recess and the other defines an aperture extending completely therethrough and coaxial with said thread receiving recess and threaded means extending through said aperture secured in said platform defining said aperture and threaded to said thread receiving recess to move said heel and toe platforms relative to each other.

5. An adjustable platform ski binding mount for use with a ski, which comprises:
   a. a platform base secured to said ski;
   b. separate heel and toe platforms mounted on said platform base and movable on said platform base toward and away from each other;
   c. means secured in said platform base for moving said toe and heel platforms together along a surface of said platform base and
   d. means positioned in one of said toe and heel platforms for moving the other of said toe and heel platforms relative to said one of said toe and heel platforms, wherein one of said heel and toe platforms has a thread receiving recess and the other defines an aperture extending completely therethrough and coaxial with said thread receiving recess and threaded means extending through said aperture secured in said platform defining said aperture and threaded to said thread receiving recess to move said heel and toe platform relative to each other.

6. An adjustable platform ski binding mount for use with a ski, which comprises:
   a. a platform base secured to said ski;
   b. separate heel and toe platforms mounted on said platform base and movable on said platform base toward and away from each other;
   c. means secured to said platform base for moving said toe and heel platforms together along a surface of said platform base and
   d. means positioned in one of said toe and heel platforms for moving the other of said toe and heel platforms relative to said one of said toe and heel platforms, wherein said heel and toe platforms are movable relative to each other along a predetermined axis and said means in (c) moves said heel and toe platforms together along said axis, and wherein one of said heel and toe platforms has a thread receiving recess and the other defines an aperture extending completely therethrough and coaxial with said thread receiving recess and threaded means extending through said aperture secured in said platform defining said aperture and threaded to said thread receiving recess to move said heel and toe platforms relative to each other.

7. An adjustable platform ski binding mount for use with a ski which comprises:
   a. platform base secured to said ski;
   a pair of separate heel and toe platforms for supporting a respective ski binding thereon;
   means mounting each of said heel and toe platforms directly on said platform base for movements relative to each other along said platform base;
   means adjustably connecting together said heel and toe platforms for effecting said movements relative to each other; and
   cooperating means on said platform base and on at least one of said heel and toe platforms for moving them together as a unit along with platform base.

8. An adjustable platform ski binding mount as set forth in claim 7 wherein said heel and toe platforms are movable relative to each other along a predetermined axis and said cooperating means moves said heel and toe platforms together along said axis.

9. An adjustable ski binding mount as set forth in claim 7 further including anti-friction means on one of said heel and toe platforms to reduce friction between said heel or toe platform and a ski boot positioned thereon.

10. An adjustable ski binding as set forth in claim 9 wherein said anti-friction means is a flexible endless belt mounted on said toe platform.

11. An adjustable ski binding as set forth in claim 9 wherein said anti-friction means is a movable bearing surface mounted on the heel platform.

12. An adjustable ski binding as set forth in claim 11 wherein said bearing surface is smooth.

13. An adjustable ski binding as set forth in claim 11 wherein said bearing surface is rough.

14. An adjustable ski binding as set forth in claim 11 wherein said bearing surface is spiked.

15. An adjustable ski binding as set forth in claim 9 wherein said anti-friction means is at least one roller bearing mounted on said toe platform.

16. An adjustable ski binding as set forth in claim 9, wherein said anti-friction means is a polytetrafluoroethylene pad.

17. An adjustable platform ski binding mount according to claim 7 wherein said cooperating means comprises a threaded recess in said platform base and a threaded member rotatable in said recess and engageable with at least one of said heel and toe platforms.

18. An adjustable platform ski binding mount as set forth in claim 17 wherein said means adjustably connecting comprises a threaded recess in one of said heel and toe platforms and means carried by the other one of said heel and toe platforms cooperating with said threaded recess for effecting relative movements of said heel and toe platforms to adjustably vary the distance between them.

19. An adjustable platform ski binding mount as set forth in claim 18 wherein only an intermediate portion of said platform base is in contact with the ski, said portion being shorter than the combined lengths of the heel and toe platforms, the remaining portions of the platform base being free of contact with the ski.

20. An adjustable platform ski binding mount as set forth in claim 17 wherein only an intermediate portion of said platform base is in contact with the ski, said portion being shorter than the combined lengths of the heel and toe platforms, the remaining portions of the platform base being free of contact with the ski.

21. An adjustable platform ski binding mount as set forth in claim 7 wherein said means adjustably connecting comprises a threaded recess in one of said heel and toe platforms and means carried by the other one of said heel and toe platforms cooperating with said threaded recess for effecting relative movements of said heel and toe platforms to adjustably vary the distance between them.

22. An adjustable platform ski binding mount as set forth in claim 21 wherein only an intermediate portion of said platform base is in contact with the ski, said portion being shorter than the combined lengths of the heel and toe platforms, the remaining portions of the platform base being free of contact with the ski.

23. An adjustable platform ski binding mount as set forth in claim 7 wherein only an intermediate portion of said platform base is in contact with the ski, said portion being shorter than the combined lengths of the heel and toe platforms, the remaining portions of the platform base being free of contact with the ski.

* * * * *